US009200538B2

(12) United States Patent
Walker et al.

(10) Patent No.: US 9,200,538 B2
(45) Date of Patent: Dec. 1, 2015

(54) INSPECTION HOLE PLUG WITH A BALL SWIVEL

(75) Inventors: David B. Walker, San Diego, CA (US); Christopher J. Meyer, San Diego, CA (US); Tsuhon Lin, San Diego, CA (US); Sean Joseph Bentley, National City, CA (US)

(73) Assignee: Solar Turbines Incorporated, San Diego, CA (US)

( * ) Notice: Subject to any disclaimer, the term of this patent is extended or adjusted under 35 U.S.C. 154(b) by 870 days.

(21) Appl. No.: 13/472,181

(22) Filed: May 15, 2012

(65) Prior Publication Data

US 2012/0282081 A1 Nov. 8, 2012

Related U.S. Application Data

(63) Continuation of application No. 12/318,401, filed on Dec. 29, 2008, now Pat. No. 8,197,187.

(51) Int. Cl.
*F01D 25/00* (2006.01)
*F01D 25/24* (2006.01)

(52) U.S. Cl.
CPC ..... *F01D 25/24* (2013.01); *F05D 2260/80* (2013.01)

(58) Field of Classification Search
CPC ..... F01D 17/02; F01D 17/20; F01D 21/003; G02B 23/2476
See application file for complete search history.

(56) References Cited

U.S. PATENT DOCUMENTS

| | | | | |
|---|---|---|---|---|
| 2,294,913 | A * | 9/1942 | Kaufman et al. | 42/121 |
| 3,362,160 | A | 1/1968 | Bourgeois | |
| 4,011,017 | A | 3/1977 | Feuerstein et al. | |
| 4,406,580 | A | 9/1983 | Baran, Jr. | |
| 4,815,276 | A | 3/1989 | Hansel et al. | |
| 5,115,636 | A | 5/1992 | Zeiser | |
| 5,185,996 | A | 2/1993 | Smith et al. | |
| 5,431,534 | A | 7/1995 | Charbonnel | |
| 5,867,976 | A | 2/1999 | Ziegler, Jr. | |
| 6,468,033 | B1 | 10/2002 | Weidlich | |
| 8,047,769 | B2 * | 11/2011 | Ballard, Jr. | 415/118 |
| 2003/0205043 | A1 | 11/2003 | Ward | |

* cited by examiner

*Primary Examiner* — Edward Look
*Assistant Examiner* — Brian O Peters
(74) *Attorney, Agent, or Firm* — Finnegan, Henderson, Farabow, Garrett & Dunner, LLP

(57) ABSTRACT

A plug for an inspection hole of a gas turbine engine is disclosed. The plug may have a stem including a first shaft, wherein a first seal is located circumferentially about the first shaft. The plug may have a swivel seal including a second seal spaced from a ball by a second shaft, and the swivel seal may be rotatably connected to the stem by the ball. The ball and the second seal may be fixed to the second shaft.

20 Claims, 5 Drawing Sheets

INSPECTION HOLE PLUG WITH A BALL SWIVEL

This application is a continuation of U.S. application Ser. No. 12/318,401, filed Dec. 29, 2008 now U.S. Pat. No. 8,197,187, which is incorporated herein by reference.

TECHNICAL FIELD

The present disclosure relates generally to a plug for an inspection hole and, more particularly, to a plug including a ball swivel.

BACKGROUND

Gas turbine engines ("GTE") are known to include several different sections that work together to generate power. For example, a GTE is known to include a compressor, a combustor, and a turbine. The compressor receives ambient air, compresses the air, and then forwards at least a portion of the compressed air into a combustion chamber of the combustor. While in the combustion chamber, the compressed air combines with fuel, and the GTE ignites the air/fuel mixture to create a flow of high-temperature compressed gas that flows into the turbine. The flow of high-temperature compressed gas impacts turbine blades, which cause one or more turbine rotors to rotate. Rotational energy from each turbine rotor is transferred to a drive axle to power a load, for example, a generator, a compressor, or a pump. Some of the compressed air from the compressor may be diverted before the combustion process for use as a flow of cooling air.

It is also known to include an inspection hole in a GTE, for example, passing through an outer casing of the GTE to permit access to an interior portion of the GTE. The inspection hole allows for inspection of the interior portions of the GTE by inspection tools or instruments, such as a borescope. Interior inspection of the GTE by the instrument through the inspection hole is typically performed during periods of maintenance, for example, when the GTE is not operating. Before the GTE returns to operation, the inspection hole is sealed, for example, by an inspection hole plug. Some GTEs are known to include a wall separating different flows of gas through the GTE. For, example, a flow of cooling gas may be separated from a flow of high-temperature gas by an internal wall. Temperature variations within the GTE may cause thermal expansion of components within the inspection hole (e.g., an inspection hole plug), and the amount of thermal expansion of each component may vary based on its proximity to the flow of high-temperature gas. Thermal expansion is known to cause undesired stresses in an inspection hole plug, which commonly leads to premature fatigue and failure of the plug.

One example of a system including an inspection hole plug is described in U.S. Pat. No. 5,431,534 to Charbonnel ("the '534 patent"). The '534 patent discloses a plug for sealing an inspection hole in each of a plurality of walls. The plug includes a pair of sealing units, wherein each of the sealing units is rotatably attached to a link rod. The plug includes a housing to cover the inspection hole. Further, the plug includes a spring to bias the sealing units away from the housing. The '534 patent states that the rotatably attached sealing units allow for thermal expansion.

Although the system of the '534 patent may disclose an inspection hole plug including a pair of sealing units that accommodate some thermal expansion, certain disadvantages persist. For example, a plug with two points of rotation may prove difficult during assembly when the inspection hole is not directly aligned with the directional force of gravity. That is, the sealing units may rotate out of alignment with the rest of the plug due to gravity and, therefore, may prove difficult to align within the inspection holes of the machine. In addition to problems with assembly, the use of a two rotating elements and a spring bias assembly may unnecessarily increase the complexity and cost of the inspection hole plug.

SUMMARY

In one aspect, the present disclosure is directed to a plug for an inspection hole of a gas turbine engine. The plug may include a stem including a first shaft, wherein a first seal is located circumferentially about the first shaft. The plug may further include a swivel seal including a second seal spaced from a ball by a second shaft, and the swivel seal may be rotatably connected to the stem by the ball. The ball and the second seal may be fixed to the second shaft.

In another aspect, the present disclosure is directed to a method of restricting a flow of gas through an inspection hole of a gas turbine engine with a plug. The method may include restricting the flow of gas through a first inner wall of the gas turbine engine with a first seal of the plug. The method may further include restricting the flow of gas through a second inner wall of the gas turbine engine with a second seal of the plug. The method may also include covering the inspection hole at an outer wall of the gas turbine with a cap. The method may additionally include permitting rotation of the first seal relative to the second seal about only a single pivot point. The method may yet further include limiting an amount of rotation of the first seal relative to the second seal by a predetermined angle.

DETAILED DESCRIPTION

Figure 1:
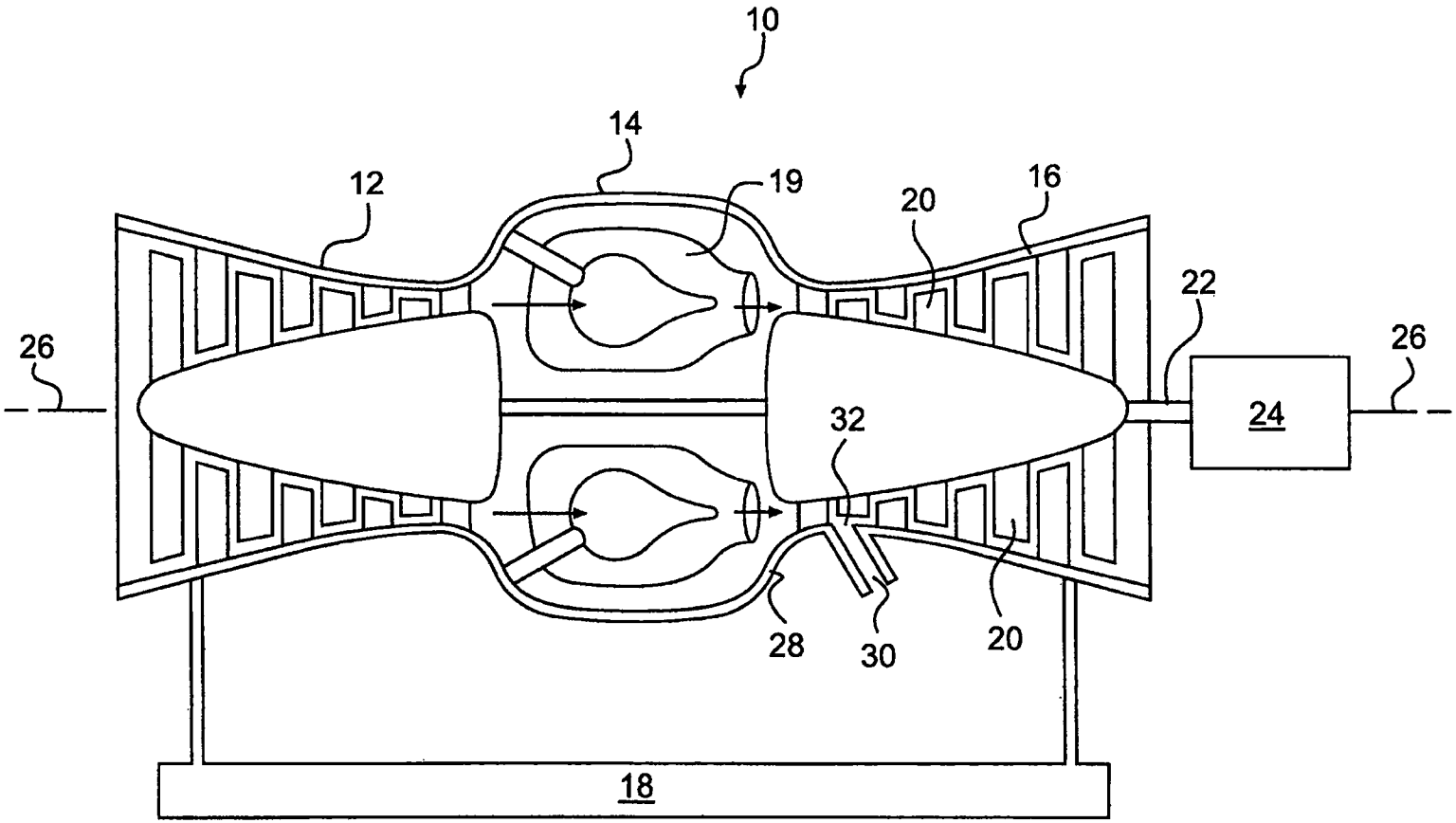
FIG. 1 is a schematic illustration of a GTE including an inspection hole, in accordance with the present disclosure.

FIG. 1 illustrates a gas turbine engine (GTE) 10. GTE 10 may have a plurality of sections, including, for example, a compressor section 12, a combustor section 14, and a turbine section 16 mounted on a stationary platform 18. During operation of GTE 10, compressor section 12 may draw air in through an air inlet duct (not shown) and compress the air before it enters combustor section 14. A portion of the compressed air from compressor section 12 may mix with fuel, and the air/fuel mixture may be ignited in a combustion chamber 19 of combustor section 14. A flow of high-temperature combustion gases ("hot gases") generated by combustor section 14 may flow through turbine section 16 and impinge on one or more turbine rotors 20 attached to a shaft 22 to provide rotary power to a load 24, for example, a generator, a compressor, or a pump. After passing through turbine section 16, the hot gases generated by combustor section 14 may be directed into an exhaust collector box (not shown) before being expelled into the atmosphere. A portion of the compressed air from compressor section 12 may bypass the combustion process for use as a flow of cooling gases ("cold gases") to cool components of GTE 10. Compressor section 12, combustor section 14, and turbine section 16 may be aligned on stationary platform 18 along a longitudinal axis 26 and covered by an outer casing 28. Outer casing 28 may include an inspection hole 30 for permitting access to one or more interior spaces 32 of GTE 10 for monitoring or inspection. Although inspection hole 30 is illustrated as facing down toward stationary platform 18, it is contemplated that inspection hole 30 may be oriented from outer casing 28 in any direction, as will be described below in greater detail.

In some situations, it may be desirable to use inspection hole 30 to inspect interior components (e.g., discs, turbine blades, turbine nozzles, etc.) of GTE 10 that are otherwise not easily accessible. More specifically, interior components of GTE 10 may be inspected with a tool or instrument (not shown), for example, a borescope or any other known device effective to inspect interior components of GTE 10. It is contemplated that interior inspections of GTE 10 through inspection hole 30 may be carried out during periods of maintenance when GTE 10 is not operating. For example, an inspection instrument may be removably inserted through inspection hole 30 to an interior space 32 of GTE 10 to perform routine or ad hoc inspection of internal components of GTE 10.

Figure 2:
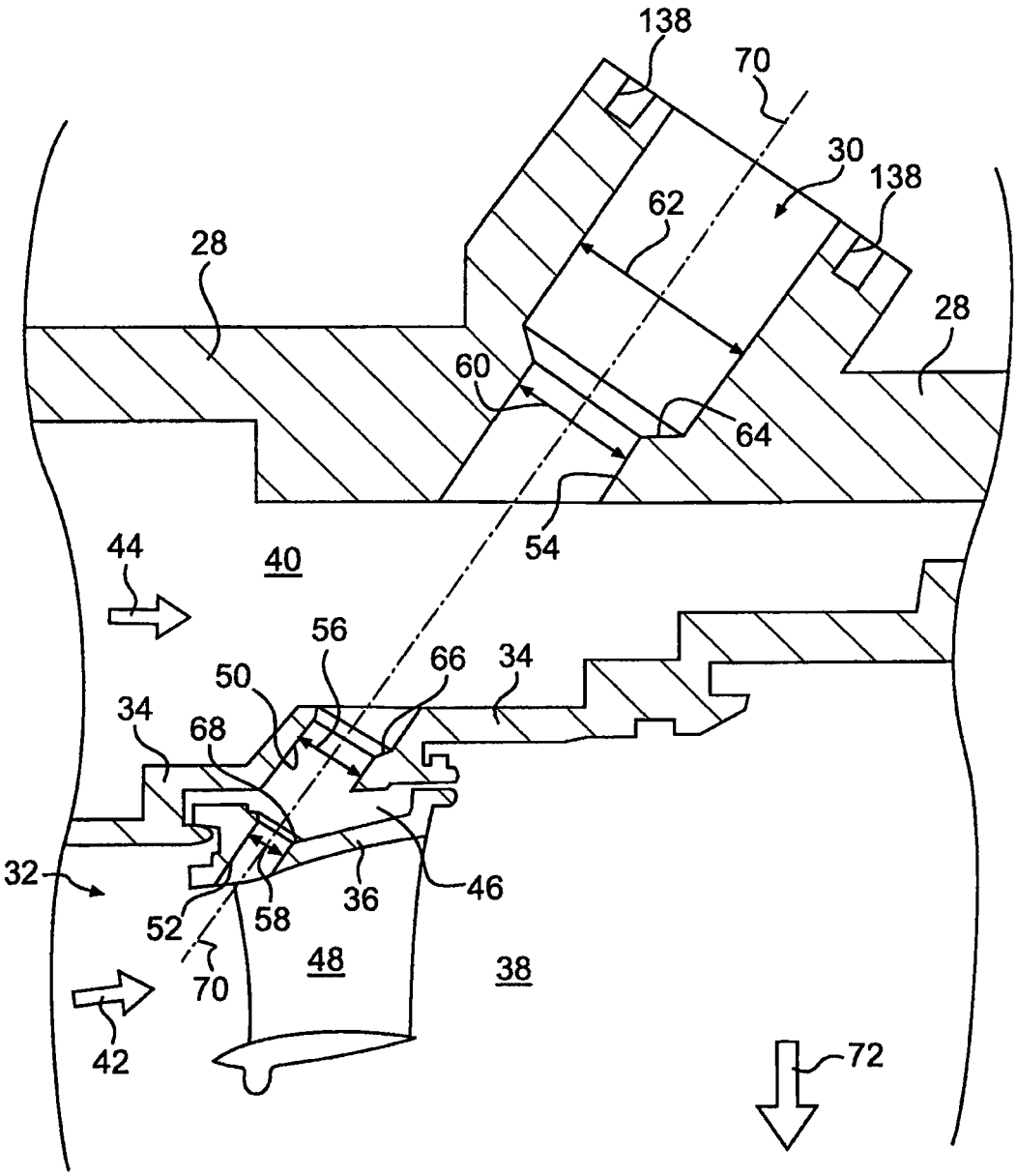
FIG. 2 is a partial cross-sectional illustration of an exemplary inspection hole of the GTE of FIG. 1.

As shown in more detail in FIG. 2, inspection hole 30 of GTE 10 may be formed through a plurality of walls including, for example, a first inner wall 34, a second inner wall 36, and outer casing 28. GTE 10 may include a first flow path defining a hot zone 38 and a second flow path defining a cold zone 40. Hot zone 38 and cold zone 40 may be separated by first inner wall 34. During operation of GTE 10, hot zone 38 may receive a flow of hot gases, as indicated by arrow 42, and cold zone 40 may receive a flow of cold gases, as indicated by arrow 44. The use of terms "hot" and "cold" may indicate that elements identified as "hot" are generally at a higher temperature than elements identified as "cold." That is, the terms "hot" and "cold" may not indicate a particular temperature range. Further, GTE 10 may include a buffer zone 46, generally defined between first inner wall 34 and second inner wall 36. It is contemplated that second inner wall 36 may be formed as part of a nozzle 48 of turbine section 16. Nozzle 48 may be configured to direct the flow of hot gases 42 to downstream turbine rotor blades (not shown). Each of first inner wall 34, second inner wall 36, and outer casing 28 may include internal bores that collectively define inspection hole 30. That is, first inner wall 34 may include a first wall bore 50, second inner wall 36 may include a second wall bore 52, and outer casing 28 may include an outer casing bore 54.

Bores 50, 52, 54 may each include substantially smooth cylindrical shaped inner surfaces. However, bores 50, 52, 54 may have different interior diameters. For example, first wall bore 50 may have a first wall bore diameter 56 that is larger than a second wall bore diameter 58 of second wall bore 52. Outer casing bore 54 may be include two diameters, a first outer casing bore diameter 60 and a second outer casing bore diameter 62. Outer casing bore 54 may include an outer casing chamfer 64 connecting sections of outer casing bore 54 defined by first and second outer casing bore diameters 60, 62. First and second outer casing bore diameters 60, 62 may each be larger than first and second inner wall bore diameters 56, 58. First and second wall bores 50, 52 may also include chamfered rims including, for example, first wall chamfered rim 66 and second wall chamfered rim 68. Each of first and second wall chamfered rims 66, 68 may taper radially inward. However, first and second wall bores may be substantially cylindrical below chamfered rims 66, 68 (i.e., having substantially constant diameters along their axial length).

Bores 50, 52, 54 may be generally aligned along an inspection hole axis 70, and in some situations, inspection hole axis 70 may be significantly misaligned with the directional force of gravity, as indicated by arrow 72. Inspection hole axis 70 may generally extend in a radial direction from longitudinal axis 26 of GTE 10. Further, axis 70 of inspection hole 30 may extend in substantially any radial direction from GTE 10. That is, when viewing GTE in cross-section in the direction of gas flow, axis 70 of inspection hole 30 may, for example, extend out of the upper portion of GTE 10 (e.g., a 12 o'clock position), a side portion of GTE 10 (e.g., a 3 o'clock or 9 o'clock positions), down from the lower portion of GTE 10 (e.g., a 6 o'clock position), or in any other radial direction. As shown in FIG. 1, it is further contemplated that axis 70 may be oriented at an angle relative to the radial direction.

Figure 3:
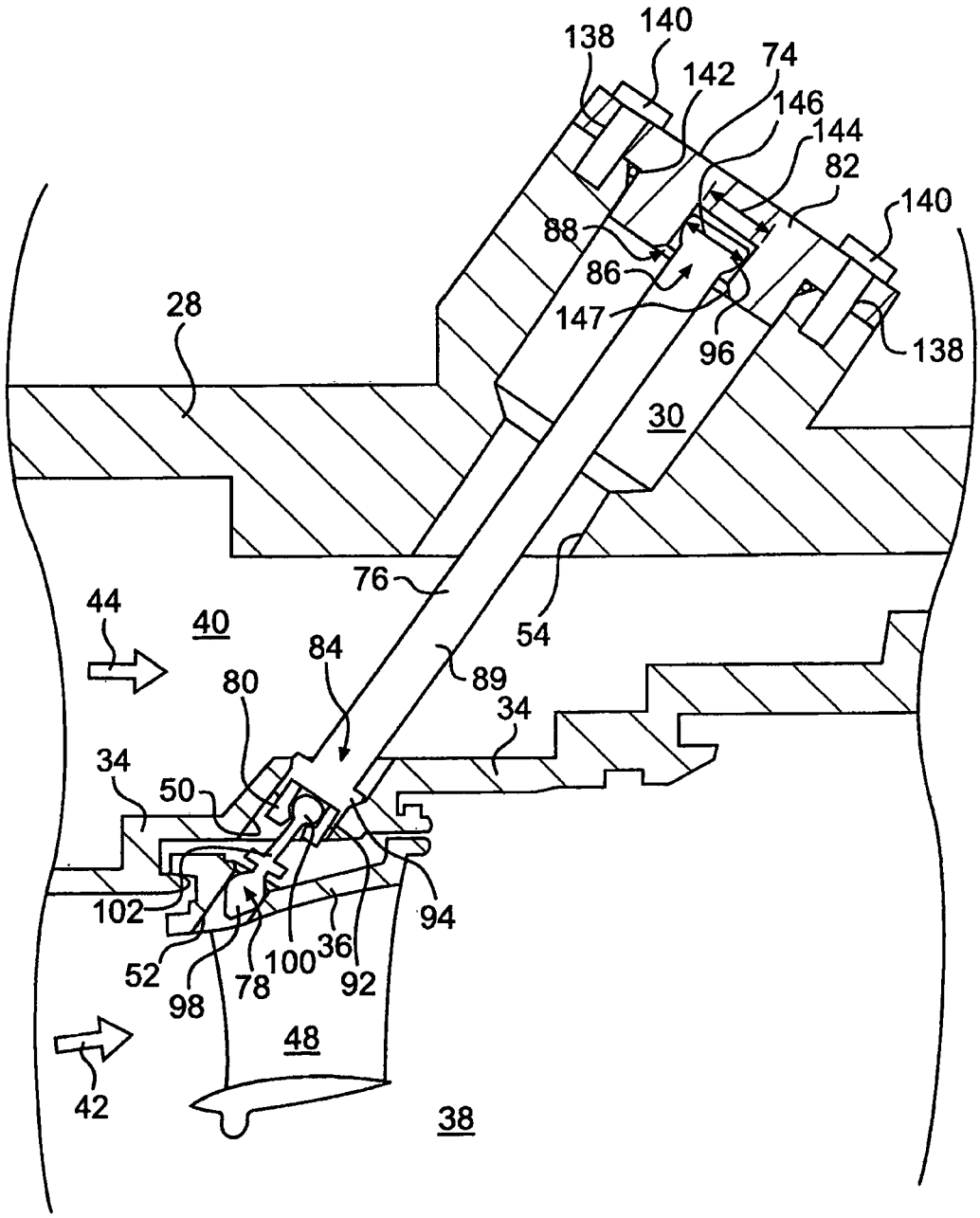
FIG. 3 is a partial cross-sectional illustration of the inspection hole of FIG. 2 including an exemplary inspection hole plug inserted therein.
Figure 4:
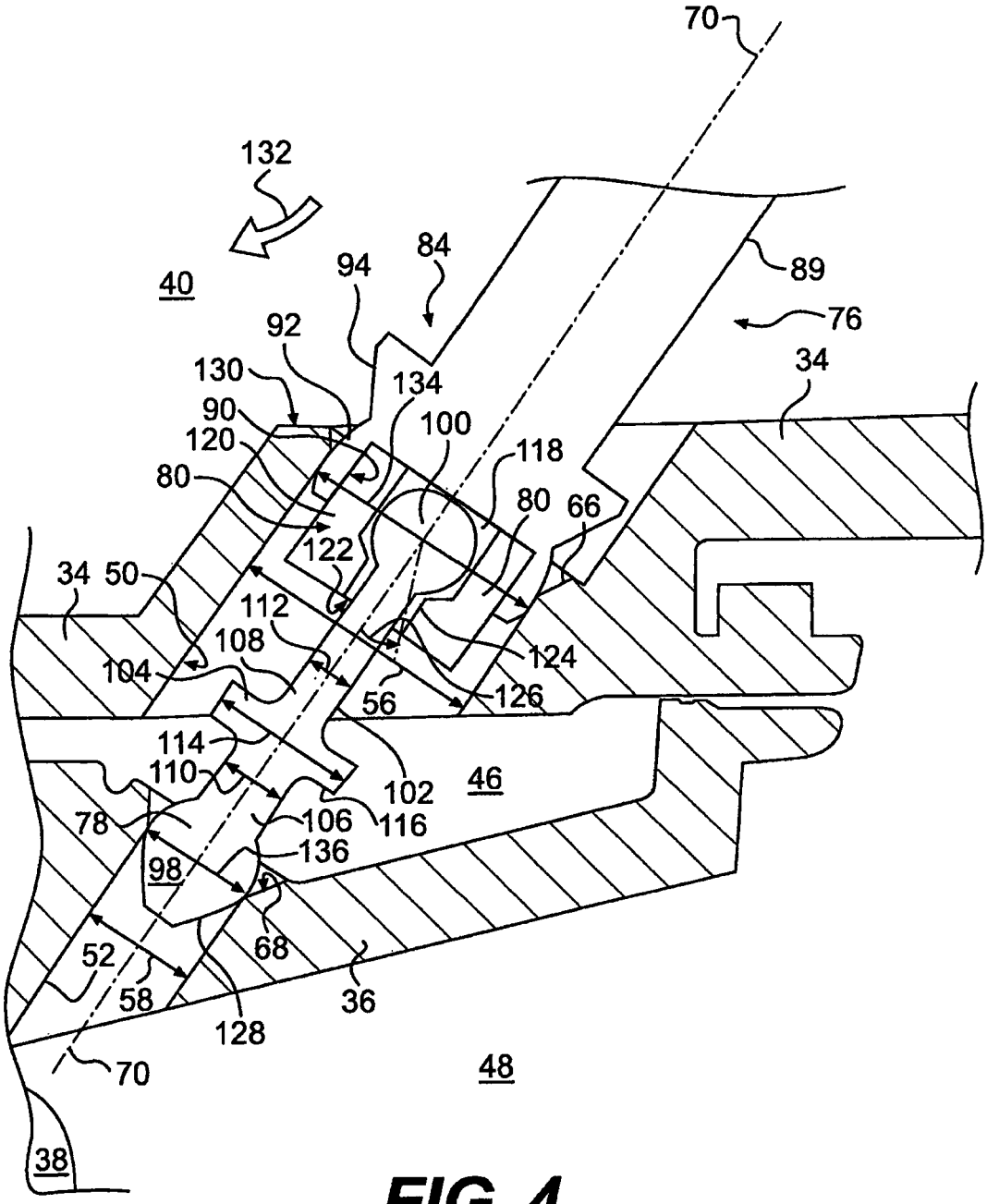
FIG. 4 is a close-up partial cross-sectional illustration of a portion of the inspection hole and inspection hole plug of FIG. 3.

As illustrated in FIG. 3, an inspection hole plug 74 may be inserted into and seal inspection hole 30 when, for example, inspection hole 30 is not being utilized for inspection or monitoring. In other words, plug 74 may be utilized when GTE 10 is operational. Plug 74 may include a stem 76, a swivel seal 78, a cover 80, and a cap 82. Plug 74 may be inserted into inspection hole 30 and each of stem 76, swivel seal 78, cover 80, and cap 82 may be substantially coaxially aligned along axis 70. As shown in FIG. 4, swivel seal 78 may be rotatably connected adjacent a first end 84 of stem 76 via cover 80. Second end 86 of stem 76 may be moveably inserted within and engage an inner wall of cap recess 88.

Stem 76 may include an elongated shaft 89 including between first end 84 and second end 86. As best illustrated in FIG. 4, stem 76 may include a stem recess 90 extending within first end 84 of stem 76 for receiving at least a portion of cover 80. It is contemplated that stem recess 90 may be substantially cylindrical. Stem 76 may also include a bulbous portion disposed circumferentially around elongated shaft 89, defining a first wall seal 92. Stem 76 may also include chamfered collar 94 disposed circumferentially about elongated shaft 89 and tapered out from first wall seal 92 toward second end 86, such that chamfered collar 94 may include a larger maximum diameter than first wall seal 92.

As best illustrated in FIG. 4, swivel seal 78 may include a second wall seal 98 spaced from a ball 100 by a shaft 102. Second wall seal 98 and ball 100 may be fixed to shaft 102. That is, second wall seal 98 and ball 100 may be non-rotatably attached to shaft 102. Further, second wall seal 98 and ball 100 may be integrally formed with shaft 102. Second wall seal 98 may include a substantially spherical portion from which a tapered tip 128 extends. For example, second wall seal 98 may be substantially tear-drop shaped. Ball 100 may be substantially spherical in shape and may serve as a pivot point between swivel seal 78 and stem 76. For example, ball 100 may be positioned within cover 80, such that ball 100 and cover 80 form a ball and socket-type connection. Shaft 102 may be separated by a shaft collar 104 into a first shaft portion 106 adjacent second wall seal 98 and a second shaft portion 108 adjacent ball 100. It is contemplated that first shaft portion 106 may have a first shaft diameter 110 and second shaft portion 108 may have a second shaft diameter 112, wherein first shaft diameter 110 may be larger than second shaft diameter 112. Further, shaft collar 104 may include a shaft collar diameter 114 that is larger than first shaft diameter 110.

In situations when a portion of swivel seal 78 may break apart from plug 74 (e.g., as a result of high temperatures), swivel seal 78 may tend to break at second shaft portion 108 because second shaft portion 108 has the smallest cross-sectional area of swivel seal 78. Therefore, if swivel seal 78 were to break apart from plug 74 at second shaft portion 108, shaft collar 104 may prevent the broken portion of swivel seal 78 from falling deeper into GTE 10 (i.e., hot zone 38) because shaft collar diameter 114 may be greater than second wall bore diameter 58. Hence, a face 116 of shaft collar 104 may abut against second inner wall 36 and block the broken portion of swivel seal 78 from falling completely through second wall bore 52.

Figure 5:
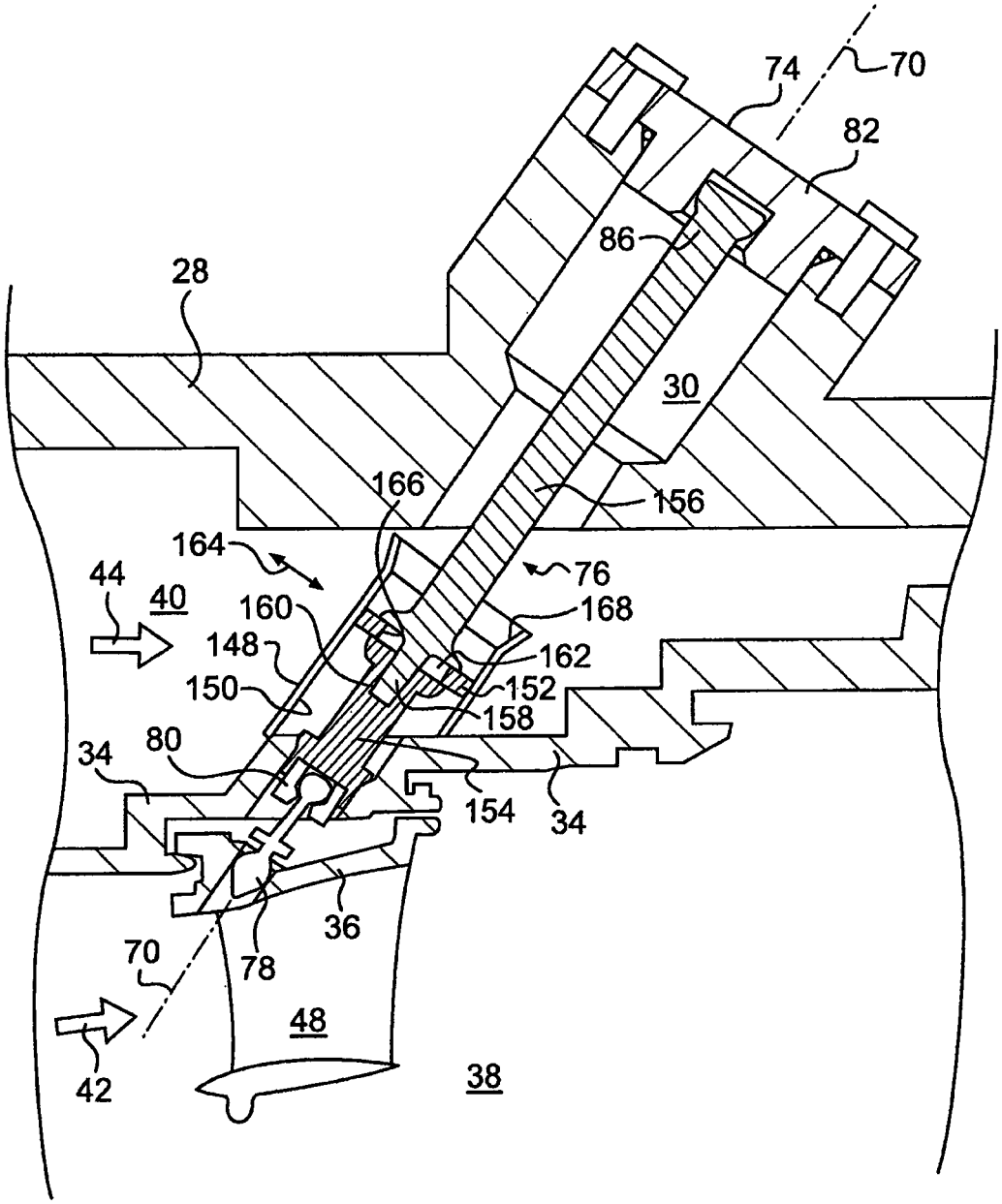
FIG. 5 is a partial cross-section illustration of the inspection hole of FIG. 2 including another exemplary inspection hole plug inserted therein.

Ball 100 may be sized to rotatably fit within a socket chamber 118 of cover 80. In order to position ball 100 within socket chamber 118, cover 80 may be formed by two shells 120 (only one shown in FIG. 4) that surround ball 100 and are secured together (e.g., by welding or brazing). However, it is contemplated that shells 120 may be attached to each other in any suitable manner. When assembled to form cover 80, each of shells 120 may form a passage 122 extending through an annular limiting shoulder 124. Passage 122 may receive second shaft portion 108 and annular limiting shoulder 124 may be sized to limit movement of second shaft portion 108 of swivel seal 78, for example, to a conical-shaped range of motion. Passage 122 may by cylindrical in shape (as shown in FIG. 4), or alternatively, may have a tapered conical shape (as shown in FIGS. 3, 5). As shown in FIG. 4, rotation of swivel seal 78 relative to stem 76 may be limited to a predetermined angle 126 from axis 70 by annular limiting shoulder 124. Annular limiting shoulder 124 may restrict movement of swivel seal 78 relative to stem 76 to help maintain a certain amount of coaxial alignment of plug 74, for example, to increase the ease of inserting plug 74 into inspection hole 30, especially when axis 70 is misaligned from the directional force of gravity 72.

The amount of rotation permitted between swivel seal 78 and stem 76, may be selected based on at least two factors. First, the selection of predetermined angle 126 may take into consideration the amount of rotation necessary to sufficiently reduce undesired bending forces along plug 74. Second, the selection of predetermined angle 126 may take into consideration the orientation of axis 70 of inspection hole 30 relative to the directional force of gravity 72 during insertion of plug 74 into inspection hole 30. That is, if swivel seal 78 were to bend too much relative to stem 76, plug 74 may not be able to be inserted within inspection hole 30. The problem associated with insertion of plug 74 into inspection hole 30 may be exaggerated when axis 70 is significantly misaligned from the directional force of gravity 72. For example, when axis 70 of inspection hole 30 is in substantial alignment with the direction force of gravity 72 (i.e., at a 12 o'clock position), the permitted amount of rotational movement of swivel seal 78 relative to stem 76 may be relatively large (e.g., in excess of 30 degrees) because plug 74 may maintain sufficient coaxial alignment under the force of gravity. In contrast, when axis 70 of inspection hole 30 is significantly misaligned with the directional force of gravity 72 (i.e., at a 3 o'clock position), the permitted amount of rotational movement of swivel seal 78 relative to stem 76 may be reduced because plug 74 may tend to substantially coaxially misalign under the force of gravity. By way of example, when axis 70 is oriented at a 2 o'clock position, predetermined angle 126 may be set to about to about 12 degrees to balance the two main factors. At an even more significant misalignment between axis 70 and the directional force of gravity 72 (e.g., at a 3 o'clock position), predetermined angle 126 may be set to about 4 degrees to balance the two main factors. It is contemplated that predetermined angle 126 may be set to within a range of between about 4 degrees and about 12 degrees. Further, predetermined angle 126 may be set to about 6 degrees to balance the two main factors.

Tapered tip 128 of second wall seal 98, in combination with second wall chamfered rim 68, may guide second wall seal 98 through inspection hole 30 into sliding engagement with second wall bore 52. Likewise, first wall chamfered rim 66 may tend to guide first wall seal 92 through inspection hole 30 into sliding engagement with first wall bore 50. In a fully inserted position (as illustrated in FIG. 3), chamfered collar 94 may seat against first wall chamfered rim 66 and limit penetration of plug 74 into inspection hole 30. When chamfered collar 94 is seated on first wall chamfered rim 66, chamfered collar 94 may also tend to hold plug 74 in substantial alignment with axis 70. Further, like shaft collar 104, chamfered collar 94 may also be sized to act as a safety catch to inhibit undesired movement of plug 74 into GTE 10. For example, chamfered collar 94 may be sized to prevent insertion of plug 74 out of alignment with axis 70. That is, chamfered collar 94 may be sized to catch on edge 130 of first inner wall 34 so that plug 74 may be prevented from entering cold zone 40 in a direction indicated by arrow 132.

First wall seal 92 may include a maximum outside diameter 134 that is substantially the same diameter or a slightly smaller diameter first wall bore diameter 56, such that first wall seal 92 may substantially seal the flow of gases through first wall bore 50. Second wall seal 98 may include a maximum outside diameter 130 that is substantially the same diameter or a slightly smaller diameter than second wall bore diameter 58, such that second wall seal 98 may substantially seal the flow of gases through second wall bore 52.

As best shown in FIG. 3, cap 82 may cover inspection hole 30 adjacent outer casing bore 54 when plug 74 (i.e., stem 76, swivel seal 78, and cover 80) is positioned within inspection hole 30. Cap 82 may be removably fastened to outer casing 28 by one or fasteners. For example, cap 82 may include one or more fastener holes 138, each receiving a corresponding fastener 140. Fasteners 140 may be any type of fastener sufficient to secure cap 82 to outer casing 28 including, for example, a bolt. Alternatively, it is also contemplated that cap 82 and outer casing 28 may include a threaded connection for fastening cap 82 to outer casing 28. A sealing device, for example, a gasket 142 may be positioned between cap 82 and outer casing 28 to improve the sealing characteristics of cap 82.

Cap recess 88 may be substantially centered along axis 70 and include a cap recess diameter 144 that may be slightly larger than a shoulder diameter 146 of a shoulder 96 of stem 76. Therefore, cap 82 may permit shoulder 96 of stem 76 to move in cap recess 88, for example, substantially aligned with axis 70 to permit thermal expansion. Further, cap recess 88 may include a cap recess chamfered rim 147 for guiding second end 86 of stem 76 into cap recess 88.

As shown in FIG. 5, it is also contemplated that inspection hole 30 may include a shroud 148 formed between first inner wall 34 and outer casing 28. Shroud 148 may extend from first inner wall 34 in substantial alignment with axis 70 of inspection hole 30 and define a shroud bore 150 for receiving a stem seal 152. Stem 76 may include a first stem portion 154 and a second stem portion 156. Second stem portion 156 may include a rod 158 that may be inserted within a recess 160 of first stem portion 154. Rod 158 may extend into recess 160 to provide a gap 162 between first and second stem portions 154, 156 for receiving and permitting limited movement of stem seal 152. For example, stem seal 152 may be permitted limited radial movement, as indicated by arrow 164, because a central bore 166 within stem seal 152 may be larger in diameter than an outside diameter of rod 158. It is further contemplated that gap 162 may be sized to substantially limit movement of swivel seal 78 in a direction substantially along axis 70. However, stem seal 152 may move axially within shroud bore 150, for example, when plug 74 undergoes thermal expansion. Further, a shroud chamfered rim 168 may help guide stem seal 152 into shroud bore 150 during insertion of plug 74 into inspection hole 30. First and second stem portions 154, 156 may be secured together (e.g., by welding or brazing) once stem seal 152 is installed therebetween. While rod 158 is described and shown integral with second stem portion 156, and recess 160 is described and shown within first stem portion 154, it is contemplated that the reverse orientation may be implemented. That is, rod 158 may be formed as part of first stem portion 154 and recess 160 may be formed within second stem portion 156.

INDUSTRIAL APPLICABILITY

The disclosed inspection hole plug may be applicable to any inspection hole within a GTE. The process of installing plug 74 into inspection hole 30 and regulating a flow of gases with plug 74 will now be described.

After performing maintenance tasks, an inspection tool (not shown) may be removed from inspection hole 30 and inspection hole 30 may be sealed with plug 74. Plug 74 (i.e., stem 76, swivel seal 78, and cover 80) may be may be inserted into inspection hole 30 and guided by one or more of chamfered rims 64, 66, 66 until plug 74 rests in a fully inserted position (as illustrated in FIG. 3). For example, the fully inserted position may be achieved, for example, when second wall seal 98 enters second wall bore 52, first wall seal 92 enters first wall bore 50, and chamfered collar 94 seats against first wall chamfered rim 66. Since rotational movement of swivel seal 78 relative to stem 76 may be limited by annular limiting shoulder 124 of cover 80 to predetermined angle 126, plug 74 may maintain sufficient alignment of swivel seal 78 to stem 76 to permit plug 74 to pass to the fully inserted position. The engagement between first wall seal 92 and first wall bore 50, as well as the engagement between chamfered collar 94 and first wall chamfered rim 66, may tend to hold stem 76 in alignment with axis 70. When stem 76 is seated on first wall chamfered rim 66 and in substantial alignment with axis 70, cap 82 may be inserted over second end 86 of stem 76, as to allow shoulder 96 to axially move into cap recess 88. Then, cap 82 may be secured to outer casing 28, for example, using one or more fasteners 140.

During operation, GTE 10 may generate a flow of hot gases 42 and a flow of cold gases 44. Each flow of gases 42, 44 may be substantially limited from passing through inspection hole 30 (i.e., between hot zone 38 and cold zone 40) when plug 74 is inserted into inspection hole 30. That is, first and second wall seals 92, 98 may tend to seal first and second wall bores 50, 52. While first and second wall seals 92, 98 may be sized to seal first and second wall bores 50, 52, it is contemplated that a small amount of gas flow may pass around first and second wall seals 92, 98 and through first and second wall bores 50, 52 due to design tolerances. The passage of the small amount of gas flow through first and second wall bores 50, 52 may be acceptable in order to achieve sufficient clearance to permit first and second wall seals 92, 98 to move axially within first and second wall bores 50, 52.

Heat generated by GTE 10 may tend to cause undesired stresses in plug 74 including, for example, undesired bending forces. In order to reduce undesired bending stresses in plug 74, first and second wall seals 92, 98 may have limited axial movement (i.e., in substantial alignment with axis 70) within first and second wall bores 50, 52. Shoulder 96 of stem 76 may also have limited axial movement (i.e., in substantial alignment with axis 70) within cap recess 88. In addition to permitting limited axial movement, plug 74 may also be permitted to freely rotate about axis 70 and may be permitted limited rotation about ball 100. That is, plug 76 may permit limited rotational movement of swivel seal 78 relative to stem 76 about ball 100. The amount of rotation of swivel seal 78 relative to stem 76 about ball 100 may be limited to predetermined angle 126 to balance the factors of reducing undesired bending forces and maintaining ease of assembly. For example, when axis 70 is oriented at a 3 o'clock position, predetermined angle 126 may be set to about to about 6 degrees from axis 70.

Further, pressure may typically be greater in cold zone 40 than the pressure in hot zone 38. The higher pressure generated in cold zone 40 may tend to force plug 74 (i.e., stem 76, swivel seal 78, and cover 80) into inspection hole 30 towards hot zone 38. That is, the higher pressure generated in cold zone 40 may tend to maintain chamfered collar 94 seated against first wall chamfered rim 66 during operation of GTE 10. Therefore, it is contemplated that a biasing device, such as a spring, may not be required to maintain chamfered collar 94 seated against first wall chamfered rim 66.

It will be apparent to those skilled in the art that various modifications and variations can be made to the disclosed inspection hole plug without departing from the scope of the disclosure. Other embodiments of the inspection hole plug will be apparent to those skilled in the art from consideration of the specification and practice of the system disclosed herein. It is intended that the specification and examples be considered as exemplary only, with a true scope of the disclosure being indicated by the following claims and their equivalents.

We claim:

1. A plug for an inspection hole of a gas turbine engine, comprising:

a stem extending along an axis, the stem including a first stem portion, a second stem portion, and a rod connecting the first stem portion to the second stem portion, wherein radially outward of the rod, there is a gap between the first and second stem portions in the direction of the axis; and a stem seal extending circumferentially around the rod in the gap between the first stem portion and the second stem portion and between radially extending surfaces of both the first and second stem portions, the stem seal having a central opening that is radially larger than the rod, allowing the stem seal to move radially relative to the rod.

2. The plug of claim 1, wherein in the direction of the axis, the stem seal substantially spans the gap between the first stem portion and the second stem portion.

3. The plug of claim 2, wherein the central opening of the stem seal is a bore.

4. The plug of claim 3, further comprising a swivel seal rotatably connected to the stem, the swivel seal being spaced from the stem seal in the direction of the axis.

5. The plug of claim 2, further comprising a swivel seal rotatably connected to the stem, the swivel seal being spaced from the stem seal in the direction of the axis.

6. The plug of claim 1, further comprising a swivel seal rotatably connected to the stem, the swivel seal being spaced from the stem seal in the direction of the axis.

7. The plug of claim 1, wherein the central opening of the stem seal is a bore.

8. The plug of claim 1, wherein the stem seal extends radially beyond the first and second stem portions.

9. The plug of claim 1, wherein the central opening of the stem seal is a bore sized to allow radial movement of the stem seal without contact with the rod.

10. The plug of claim 1, wherein the first and second portions are fixedly secured together.

11. A plug for an inspection hole of a gas turbine engine, comprising:

a stem extending along an axis, the stem including a first stem portion, a second stem portion, and a rod connecting the first stem portion to the second stem portion, wherein radially outward of the rod, there is a gap between the first and second stem portions in the direction of the axis;

a stem seal extending circumferentially around the rod in the gap between the first stem portion and the second stem portion and between radially extending surfaces of both the first and second stem portions, the stem seal having a central opening that is radially larger than the rod, allowing the stem seal to move radially relative to the rod, wherein the stem seal extends radially beyond all portions of the first and second stem portions;

a swivel seal rotatably connected to the stem, the swivel seal being spaced from the stem seal in the direction of the axis.

12. The plug of claim 11, wherein in the direction of the axis, the stem seal substantially spans the gap between the first stem portion and the second stem portion.

13. The plug of claim 12, wherein the central opening of the stem seal is a bore.

14. The plug of claim 11, wherein the central opening of the stem seal is a bore sized to allow radial movement of the stem seal without contact with the rod.

15. The plug of claim 11, wherein the first and second portions are fixedly secured together.

16. A plug for an inspection hole of a gas turbine engine, comprising:

a stem extending along an axis, the stem including a first stem portion, a second stem portion, and rod extending from one of the first or second stem portions into a recess of the other of the first or second stem portions, the rod fixedly connecting the first stem portion to the second stem portion, wherein radially outward of the rod, there is a gap between the first and second stem portions in the direction of the axis; and a stem seal extending circumferentially around the rod in the gap between the first stem portion and the second stem portion and between radially extending surfaces of both the first and second stem portions, the stem seal having a central opening that is radially larger than the rod, allowing the stem seal to move radially relative to the rod.

17. The plug of claim 16, wherein in the direction of the axis, the stem seal substantially spans the gap between the first stem portion and the second stem portion.

18. The plug of claim 17, wherein the central opening of the stem seal is a bore.

19. The plug of claim 18, further comprising a swivel seal rotatably connected to the stem, the swivel seal being spaced from the stem seal in the direction of the axis.

20. The plug of claim 17, further comprising a swivel seal rotatably connected to the stem, the swivel seal being spaced from the stem seal in the direction of the axis.

* * * * *